US007159962B2

(12) United States Patent
Wouters

(10) Patent No.: US 7,159,962 B2
(45) Date of Patent: Jan. 9, 2007

(54) WIPER ASSEMBLY FOR INKJET PRINTER

(75) Inventor: Paul Wouters, Bonheiden (BE)

(73) Assignee: Agfa-Gevaert N.V., Mortsel (BE)

( * ) Notice: Subject to any disclaimer, the term of this patent is extended or adjusted under 35 U.S.C. 154(b) by 195 days.

(21) Appl. No.: 10/757,627

(22) Filed: Jan. 14, 2004

(65) Prior Publication Data

US 2005/0088480 A1 Apr. 28, 2005

Related U.S. Application Data

(60) Provisional application No. 60/445,082, filed on Feb. 5, 2003.

(30) Foreign Application Priority Data

Jan. 23, 2003 (EP) ..... 03100136

(51) Int. Cl.
*B41J 2/165* (2006.01)

(52) U.S. Cl. ..... 347/33

(58) Field of Classification Search ..... 347/22, 347/28, 29, 33, 32
See application file for complete search history.

(56) References Cited

U.S. PATENT DOCUMENTS 5,481,283 A 1/1996 Watanabe et al.
5,552,811 A * 9/1996 Kurata et al. ..... 347/28
6,084,608 A 7/2000 Harvey et al.
6,106,099 A * 8/2000 Mou et al. ..... 347/33
6,193,353 B1 2/2001 Vives et al.
6,478,402 B1 11/2002 Greive
6,669,328 B1 * 12/2003 Lin ..... 347/33

FOREIGN PATENT DOCUMENTS

EP 0 911 170 A2 4/1999
EP 1 018 430 A1 7/2000
EP 03 10 0136 6/2003
EP 1366907 A1 12/2003
EP 1366907 B1 12/2003

* cited by examiner

*Primary Examiner*—Shih-Wen Hsieh
(74) *Attorney, Agent, or Firm*—Robert A. Sabourin

(57) ABSTRACT

A wiper assembly is used to mount large size wiper blades for use in industrial inkjet printers. In order to provide an even wiping action over the length of a print head the wiper is sideways clamped in a rigid wiper blade holder and held in place by a clamping block. Preferably the wiper assembly clamps the wiper over about 20% of the wiper height. The assembly allows for use of individual wiper blades having different characteristics. Separate wiper blades are more easily fabricated and can be replaced easily. The wiper blades may be provided with a heel which enhances mounting efficiency. The wiper assembly may include provisions for easy mounting to allow for rapid exchange of the whole wiper assembly in a printer.

4 Claims, 5 Drawing Sheets

WIPER ASSEMBLY FOR INKJET PRINTER

The application claims the benefit of U.S. Provisional Application No. 60/445,082 filed Feb. 5, 2003.

FIELD OF THE INVENTION

The present invention relates to inkjet printing mechanisms, such as printers or plotters.

More particularly the present invention relates to a mechanism for cleaning a print head after it has been purged in order to clear obstructed nozzles.

BACKGROUND OF THE INVENTION

Nowadays inkjet printing systems are used in a wide array of apparatuses in a wide array of applications such as fax, colour photo printing, industrial applications etc. In these printing systems inks, possibly of various colours, is ejected out of an array of nozzles located in a print head to the receiving material.

A long known problem in inkjet printers is that the nozzles through which the ink is projected to the receiving material are blocked by clogging of ink inside the nozzles and on the print head. This renders certain nozzles inoperable and results in a defective print of deteriorated print quality.

To improve the clarity and contrast of the printed image, recent research has been focused to improvement of the used inks. To provide quicker, more waterfast printing with darker blacks and more vivid colours, pigment based inks have been developed. These pigment-based inks have a higher solid content than the earlier dye-based inks. Both types of ink dry quickly, which allows inkjet printing mechanisms to forms high quality images.

In some industrial applications, such as making of printing plates using ink-jet processes, inks having special characteristics causing specific problems. e.g. UV curable inks exist to allow rapid hardening of inks after printing.

The combination of small nozzles and quick drying ink leaves the print heads susceptible to clogging, not only from dried ink and minute dust particles or paper fibres, but also from the solids within the new ink themselves.

It is known to counteract or correct the problem of clogging by protecting and cleaning the print head by various methods.

- Wiping: Before an during printing the inkjet print head is wiped clean by using an elastomeric wiper, removing ink residue, paper dust and other impurities.
- Capping: during non-operational periods the print head can sealed off from contaminants by a sealing enclosure. This also prevents the drying of the ink. The capping unit usually consists of a rubber seal placed around the nozzle array.
- Spitting: by periodically firing a number of drops of ink through each nozzle into a waste ink receiver, commonly called a spittoon, clogs are cleared from the nozzles. This can be concentrated to nozzles which are not used for a certain time but usually all the nozzles are actuated during spitting.
- Vacuum assisted purging: During a special operation in order to clear partially or fully blocked nozzles a printing is actuated while on the outside of the nozzles a vacuum is applied. This helps clearing and cleansing the nozzles. The purging is normally performed when the print head is in the capping unit as this unit can provide a good seal around the nozzle array for building the vacuum.

Also other methods exist for cleaning an inkjet print head which may include applying solvents as in EP-A-1 018 430, These features designed to clean and to protect a print head, are commonly concentrated in a service station which is mounted within the plotter chassis, whereby the print head can be moved over the station for maintenance. An example of such a service station can be found in U.S. Pat. No. 6,193,353 combining wiping, capping, spitting and, purging functions.

State of the art printers have relatively small printheads having only a limited number of nozzles The wiper systems of these printheads have also relative small dimensions. E.g. a typical wiper has a length of only 10 mm. Nowadays however industrial, large volume, ink jet printers have been developed wherein larger printheads are used.

Printing speeds, ink consumption are much larger than the state of the art home and office printing machines.

The dimension of such an industrial printhead may well be up to 80 mm. In order to clean these large printheads, large size wipers are needed.

Wiper assemblies made according to the state of the art show several deficiencies when trying to use the same manufacturing methods for larger wipers.

- It is relatively easy to ensure a good and even mounting for a short wiper. Small variations in mounting over the length of the wiper will not lead to problems as the overall variation is limited due to the small dimension of the wiper.
  When using relatively large wiper the variations may be greater due to the length.
  A very small variation of in the mounting height for a wiper poses no problem, but variations of 0.2 mm in mounting height have an adverse effect on the cleaning of the nozzle plate and thus also on the printing quality. Achieving this tolerance for a 10 mm wide wiper may pose no problem, but such an accurate mounting precision for a wiper of about 70 mm is not easy to achieve. Uneven cleaning and printing is likely to occur using state of the art wipers.
- Uneven mounting can be in height but also the clamping forces of the wiper holder may vary which influences the slip of the sides of the wiper relatively to the wiper holder. Even a difference in surface finish of the wiper holder can cause variations.

Better mounting method need to be used in mounting the large wipers used in industrial inkjet printing apparatuses.

Another problem is that fabrication of unitary wipers, used in several state of the art printers, containing two or more blades with a length (e.g. 80 mm) for industrial applications is not easy and thus expensive.

- consistent properties of the two or more wipers over the large wiper length is not easy to obtain. Variation on both wiper blades may occur and to obtain constant properties, both wipers need to have constant properties.
- The unitary wiper can not be partially replaced, e.g. when the front wiper blade is worn out before the other wiper blades.
- Both blades have the same chemical composition. Making a unitary wiper with wiper blades having a different composition or internal structure is difficult and expensive. It is desirable to have the possibility to give front and rear wipers another composition and structure
- Due to the unitary fabrication the bending of one wiper blade may influence the position of adjacent wipers via the common base.

As in industrial printing apparatuses it is possible to use different types of ink, it is desirable to be able to exchange the wipers, and printheads, easily to allow quick switchover.

Another problem associated with wipers is that during the process of wiping ink adhered to the wiper blade can be flung away when the wiper clears the printhead. The wiper is full of ink as wiping of the nozzle plate is just finished and the recoiling wiper blades flings ink around contaminating the interior of the printer.

Although this problem is already known in small scale printers of office and home applications, it is larger in industrial printers as the wipers are also considerably larger in size. Measurements have to be taken to avoid this type of contamination.

Due to the large build-up of eventually dried ink on the wiper, the wiper needs to be cleaned by scraping it along a scraper. Frequent scraping of the wiper causes premature wear resulting in lower wiping efficiency and frequent need to replace the wipers which requires expensive intervention of a technician.

Another problem is that dried ink adhered to the printhead.

SUMMARY OF THE INVENTION

The above-mentioned problems are avoided by a wiper assembly having the specific features set out in claim 1. Specific features for preferred embodiments of the invention are set out in the dependent claims.

Further advantages and embodiments of the present invention will become apparent from the following description and drawings.

DETAILED DESCRIPTION OF THE INVENTION

While the present invention will hereinafter be described in connection with preferred embodiments thereof, it will be understood that it is not intended to limit the invention to those embodiments.

The objects of the invention are realised by mounting separate wipers into a wiper assembly by clamping them sideways in a rigid wiper blade holder.

This provides easy mounting and consistent behaviour during wiping over the term of life of the wiper. By clamping the sides of the wiper by a rigid wiper blade holder with sufficient strength it is ensured that no variation outside the desired tolerances occurs in height or properties due to movement of the wiper inside the assembly due to forces acting inside the elastomer wiper.

Figure 1:
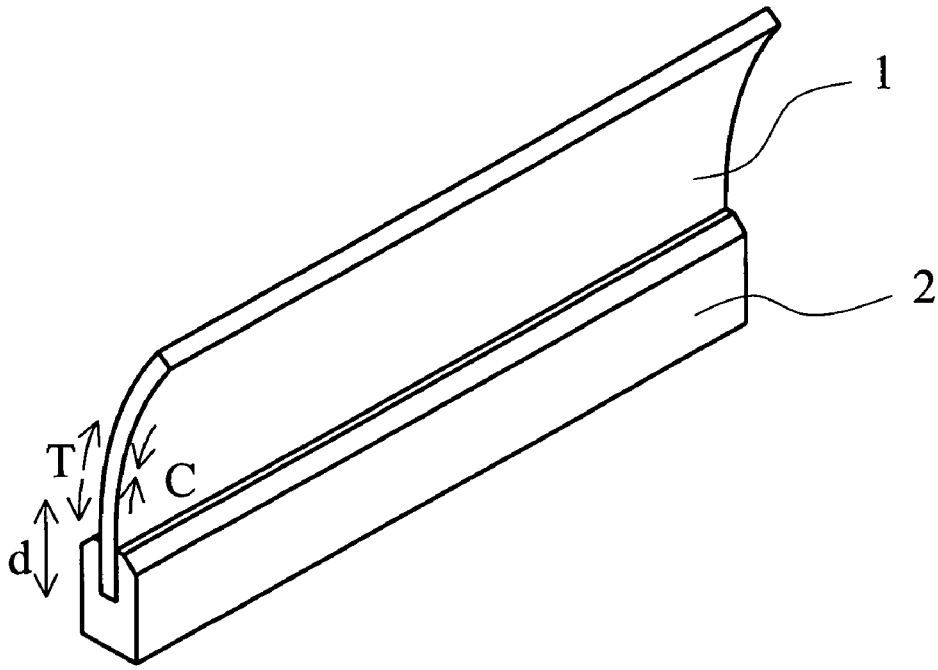
Fig. 1 (PRIOR ART)
FIG. 1 shows a prior art wiper assembly.

In FIG. 1 a wiper blade 1 mounted in a wiper holder 2 is depicted in the position in which it is bent during wiping of a printhead. Due to bending of a wiper blade internal compression C and tension T forces may cause changes in mounting position.

Internal compression C occurs at the inside of the bent wiper blade 1.

Tension forces T occur at the outside of the bent wiper blade 1.

Changes in mounting position is avoided by mechanical sideways clamping of the wiper blade 1 by a rigid wiper blade holder 2.

To totally avoid influence of these forces upon mounting it is found that the depth d needed to clamp the wiper blade 1 preferably exceeds 20% of the height of the wiper blade 1.

Internal forces are restricted to the section above the wiper blade holder 2 while the lower part of the wiper 1 is not influenced by internal forces.

Preferably the wiper blade holder 2 is made of metal to ensure that no deformation of the holder 2 will occur due to the bending of the wiper 1. Metals such as aluminium can be easily machined to desired forms. As an alternative, also rigid plastics can also be used for manufacturing the wiper blade holder, e.g. polystyrene (PS), P.O.M, Polypropylene, etc. . . .

Contrary to the home and office inkjet printers the cost factor of the wiper assembly is not very important in the inkjet printers for industrial applications. Long lifetime and reliability are much more important in high volume/high speed printing.

Figure 2:
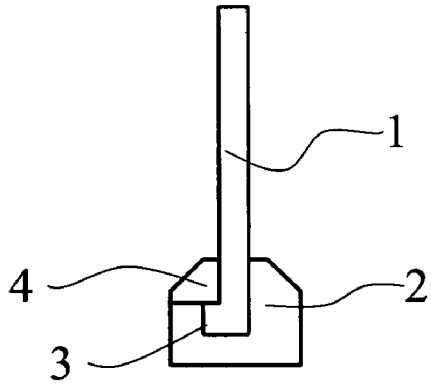
FIG. 2 shows the mounting of a wiper blade having a protruding heel.

As illustrated in FIG. 2 it is also possible to provide the wiper blade 1 with a protruding "heel" 3 during fabrication corresponding to a recess in the wiper assembly. The wiper 1 is clamped by a rigid clamping block 4. This ensures an easier constant mounting height of the wiper 1 in the wiper blade holder 2. The clamping depth remains however important. Insufficient clamping depth could result in internal forces leading to deformations outside the desired tolerances for the wiper 1 resulting in inferior wiping results.

As already mentioned above separate wipers can be easier be fabricated with constant properties than unitary wipers having multiple blades.

Figure 3:
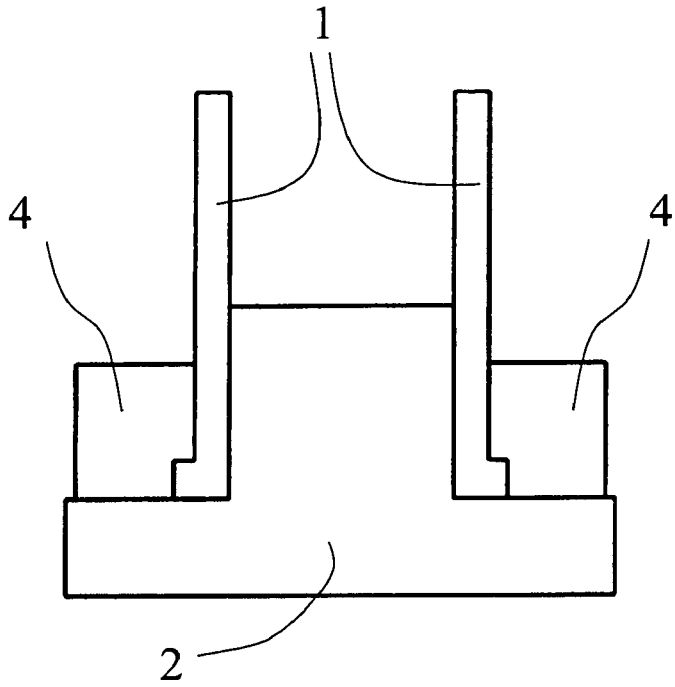
FIG. 3 shows the mounting of two wiper blades in a common wiper holder.

By independent mounting of the wiper blades, constant properties within the tolerances are ensured for the whole wiper assembly. FIG. 3 illustrates separate mounting of two wiper blades 1 in one wiper assembly 2 using separate clamping blocks 4.

Figure 4:
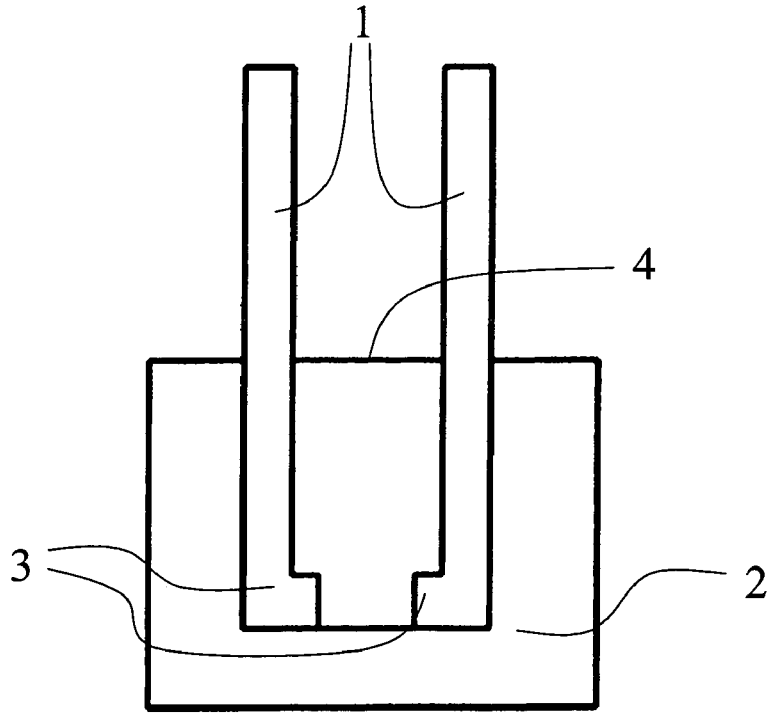
FIG. 4 shows the mounting of two wiper blades in a common holder using a common clamping part.

In FIG. 4 the wiper blades 1 are individually mounted in a common blade holder 2 using a common clamping block 4. However the movement or bending of one wiper blade 1 during wiping has no influence upon the second wiper blade 1. In order to ensure constant mounting height, both wipers 1 are provided with a heel 3.

Regarding the length of the wiper 1 in relation to the length of the printhead and the nozzle array, it is stated that the length of the wiper 1 should sufficiently exceed the length the printhead to be wiped. To ensure a constant pressure of the wiper blade 1 on the printhead to be wiped the wiper 1 should at least be 1 mmm wider at each side than the area to be wiped.

The separate mounting of individual wiper blades 1 in a wiper assembly also allows for several alternatives having advantages to unitary wipers as known in the state of the art.

As mentioned it is easier and more economically to provide long wiper assemblies having plural blades 1 with consistent tolerances.

As the blades 1 are mounted separately, it is possible to use blades 1 having a different chemical composition within one wiper assembly.

Different types of elastomer can be used for the first, second and following wipers 1 of a wiper assembly. This is illustrated in FIG. 4.

Even if the wipers 1 have the same chemical composition it is possible to provide wipers 1 with a different internal structure. Wipers may differ in e.g. surface finish, density, elasticity etc depending upon the fabrication parameters.

The separate wiper blades 1 also allows for individual replacement of wipers when necessary. The first wiper blade of the assembly will encounter much more dried ink residues on the printhead than following wiper blades. This can lead to premature wear of the leading wiper blade. The mounting method allows for separate replacement of one wiper.

This can be done while the wiper is mounted in the printer but preferably the wiper assembly is provided with a mounting mechanism allowing easy and quick replacement of the whole wiper assembly. The wiper assembly then takes the form of a integral replaceable module.

Figure 5:
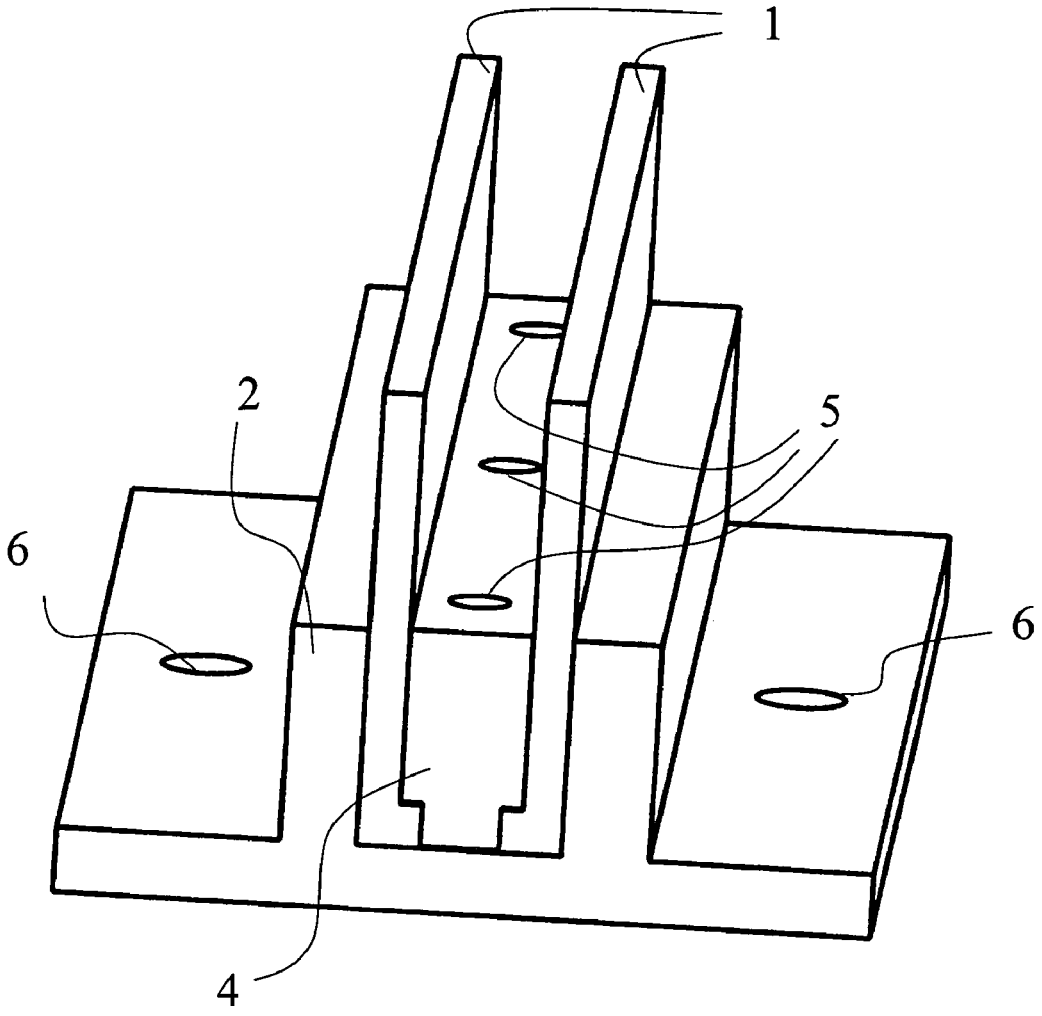
FIG. 5 shows an integral replaceable module allowing for easy changing of the wiper assembly in a printer.

In FIG. 5 an integral replaceable module is illustrated having adapted mounting means allowing for easy changing of the wiper assembly. Especially in industrial inkjet printing apparatuses this is important as those machines can be adapted to print using different inks. Easy replacement of printheads and maintenance assemblies is therefore a necessity.

The two wipers 1 are mounted in a common holder 2 and are clamped using a common clamping block 4. The clamping block 4 can be fixed to the wiper holder 2 using screws mounted in provided 5. Industrial inkjet printers need to have a reduced maintenance time. In order to provide quick changing of the wiper assembly, assembly mounting holes 6 are provided. Using screws or other type of fasteners (bayonet type locking devices) easy replacement of the integral replaceable module is possible.

This can also be necessary when changing the ink type used in the inkjet printer.

Wiping action of the large printhead can take place without adverse effects which may be caused by less stable wiper assemblies.

As mentioned above during the wiping action, ink residue is wiped from the nozzle plate and printhead by the bended wipers. To improve the wiping action the nozzles are sometimes activated to provide fresh ink to the nozzle plate to serve as solvent for dried ink. This leads to the problem that when the wipers 1 clear the printhead, thereby recoiling to their upright position, ink residue and fresh ink fluid are flung from the wiper blades. As a consequence the inside of the printers is contaminated by ink and dried ink, ect. . . .

This is already a problem in home en office environment printers but due to the larger wipers especially a problem in the industrial inkjet printers.

It is possible to limit the contamination to the inside a closed container or chamber, but it is more preferable to avoid build-up of ink and ink residue on the wipers from the start.

The build-up of ink and ink residue, paper dust etc is counteracted by applying an appropriate coating 7 to the side of the wiper.

Figure 6A:
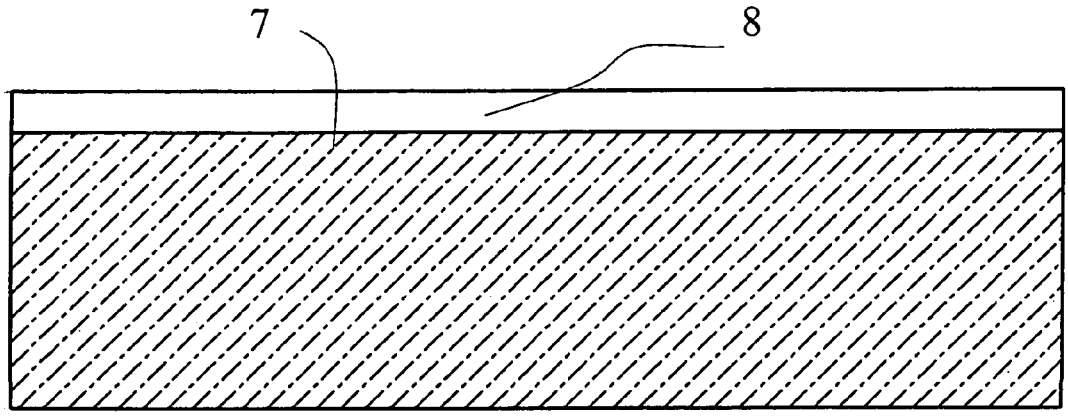
FIGS. 6A and 6B show a wiper having a non-wetting coating.
Figure 6B:
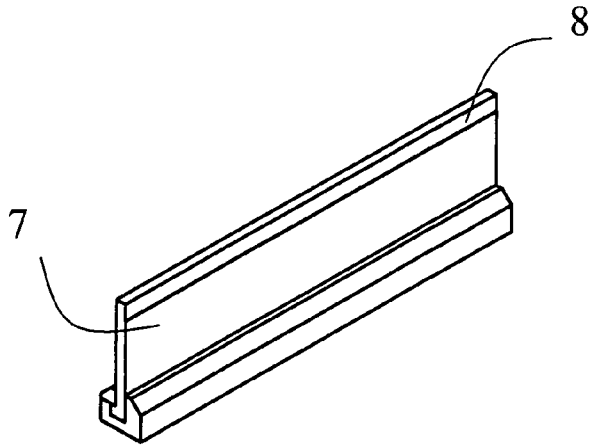

Reference is made to FIGS. 6A and 6B regarding the coating of the wiper blade 1.

This coating 7 is preferably applied to both sides of the wiper 1. The coating 7 should preferably exhibit following characteristics anti wetting properties to avoid adherence of liquid ink to the side of the wiper.

the coating 7 has to exhibit low adherence for dried ink and impurities. This is not only a matter of chemical composition of the ink and coating 7, also the surface finish of the coating 7 is important. Rough surfaces tend to allow more build-up of impurities.

Generally it is more preferable that the ink repellence is thus not only needed for liquid ink, but also for solid particles and dried ink.

It can be understood that the composition of the coating 7 will depend upon the of ink used during printing.

Different sorts of anti-wetting coatings can be applied Preferably coatings are used containing compositions from the fluoropolymer family.

Commercially available coatings are

Cytop® which is an amorphous fluorocarbon polymer. CYTOP is available in two molecular weight ranges and in a variety of concentrations in perfluorinated solvents. CYTOP resin solutions are also available with sub-micron particle filtration and with adhesion promoters.

Algoflon® which is a polytetrafluoroethylene product having excellent physical, electrical and anti-stick properties due to its high molecular weight and molecular structure.

Teflon® AF. This polymer combines low surface-free energy, low moisture absorption, and solution coating capability and makes it suitable as a coating or film for release materials. And the ability to produce very thin coatings in the micron level allows Teflon® AF to be used as a release coating for other substrates to render them non-stick surfaces.

FEP teflon-based coating have the advantage that they can be applied from a solution applied to the wiper.

Also silicone-based coatings can be applied.

Generally is has to be avoided to coat the tip 8 of wiper.

Diminished adherence of the ink to the tip 8 of the wiper could result in a reduced wiping efficiency of the wiper. Ink should be attracted to wiper tip 8 to ensure removal.

This also avoids that antiwetting coating should be transferred to the printhead and nozzle plate causing possible clogging of the nozzles or disturbance of the ink-attractant or -repellent properties of the original nozzle plate coating.

The anti-wetting coating on the side of the wiper blade(s) has the following advantageous results :

Less ink adheres to the sides of the wiper during wiping. Therefor less contamination is caused due to ink which is flung from the wiper as it recoils when it clears the printhead.

Less build-up of dried ink occurs on the side of the wipers. The wiper itself needs to be cleaned less often to ensure good wiping.

Because of the coating, dried ink will be more easily removed from the wiper.

As scraping of the wiper itself need to be done less often, wear is reduced and wipers will last more operating hours, leading to less cost in maintenance etc.

EXAMPLE

Figure 7A:
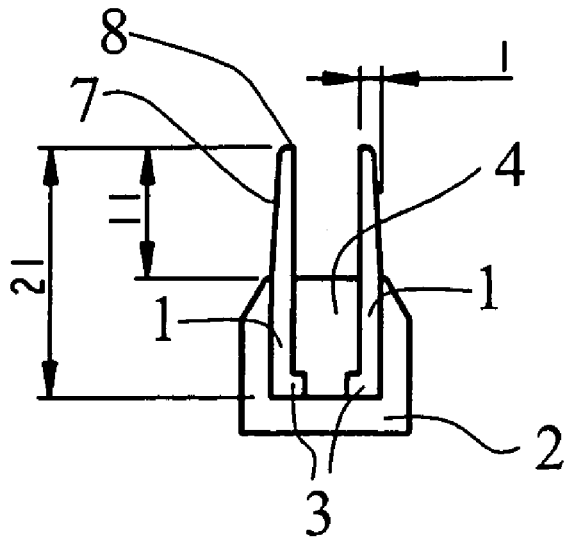
FIGS. 7A and 7B show a practical embodiment according to the present invention.
Figure 7B:
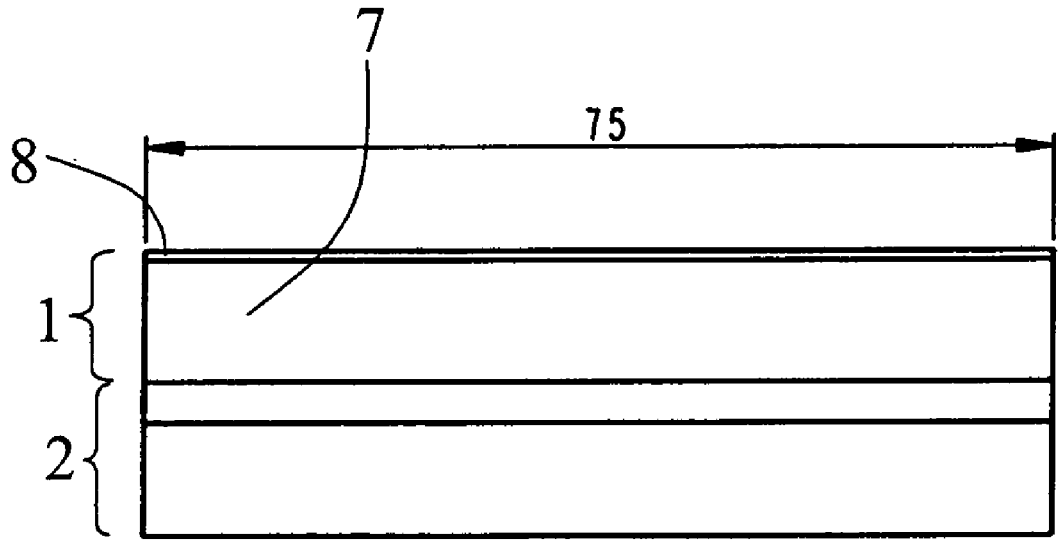

FIG. 7 shows a dual wiper assembly of an industrial inkjet printer. The wipers are separately mounted in the assembly using a common clamping block.

Wipers are 1.8 mm thick having a rubber composition with a hardness between 40 and 80 ShoreA and they are provided with a protruding heel to ensure correct mounting height during assembly of the wiper assembly.

The wipers have a total height of 21 mm and are clamped by the holder over a distance of 10 mm which is about 50% of the wipers height. This ensures a very rigid mounting of the wiper blades over the total length which is about 75 mm. Bending forces during wiping can not cause displacement of the wipers in the wiper assembly.

The wiper sides are coated with a sub-micron film of Cytop, which is an amorphous, fluorocarbon polymer. This can be applied by e.g. dipping the wiper blades in a selected perfluorinated solvent and drying them before assembly. This ensures that practically no ink adheres to the side of the wipers during and after wiping the printhead.

In another embodiment at least one side of the wiper is left uncoated at about 1.5 mm from the top of the wiper. This ensures ink attractant properties of the wiper tip 8. At least 0.3 mm from the top is left uncoated. The tip 8 itself may be coated with an ink attractant coating.

Because wipers 1 and wiper sides may differ in surface finish or composition, it is also possible to have different coatings 7 on separate wiper blades 1 or on the opposite sides of a wiper blade 1 to ensure less ink build-up.

Having described in detail preferred embodiments of the current invention, it will now be apparent to those skilled in the art that numerous modifications can be made therein without departing from the scope of the invention as defined in the appending claims.

PART LIST

1. Wiper blade(s)
2. Blade holder
3. Protruding heel
4. Rigid (common) clamping block(s)
5. Clamping block mounting holes
6. Assembly mounting holes
7. (Anti-wetting) coating
8. Wiper tip

The invention claimed is:

1. Wiper assembly for wiping a print head with a nozzle plate in an inkjet printing system, the wiper assembly comprising:

at least two wiper blades;

a rigid blade holder for supporting the wiper blades;

at least one rigid clamping block extending a length of the wiper blades for clamping and securing the wiper blades between the blade holder and the clamping block, wherein at least two of said wiper blades are clamped separately by said blade holder.

2. Wiper assembly according to claim 1 wherein at least one said wiper blade has a protruding heel.

3. Wiper assembly for wiping a print head with a nozzle plate in an inkjet printing system, the wiper assembly comprising:

at least one wiper blade;

a rigid blade holder for supporting the wiper blade;

at least one rigid clamping block extending a length of the wiper blade for clamping and securing the wiper blade between the blade holder and the clamping block, wherein the at least one said wiper blade has a protruding heel.

4. Wiper assembly according to claim 3 further comprising two or more said wiper blades wherein at least two of said wiper blades are clamped separately by said blade holder.

* * * * *